US005931719A

United States Patent [19]

Nagahara et al.

[11] Patent Number: 5,931,719

[45] Date of Patent: Aug. 3, 1999

[54] METHOD AND APPARATUS FOR USING PRESSURE DIFFERENTIALS THROUGH A POLISHING PAD TO IMPROVE PERFORMANCE IN CHEMICAL MECHANICAL POLISHING

[75] Inventors: Ronald J. Nagahara, San Jose; Dawn M. Lee, Morgan Hill, both of Calif.

[73] Assignee: LSI Logic Corporation, Milpitas, Calif.

[21] Appl. No.: 08/918,846

[22] Filed: Aug. 25, 1997

[51] Int. Cl.[6] ..... B24B 1/00

[52] U.S. Cl. ..... 451/41; 451/287; 451/288; 451/504; 451/505; 451/56

[58] Field of Search ..... 451/41, 285, 290, 451/384, 504–505, 495, 56, 303

[56] References Cited

U.S. PATENT DOCUMENTS

| | | | |
|---|---|---|---|
| 1,212,628 | 1/1917 | Gowlland | 451/505 |
| 4,270,316 | 6/1981 | Kramer et al. . | |
| 4,313,284 | 2/1982 | Walsh . | |
| 4,918,869 | 4/1990 | Kitta | 451/288 |
| 4,930,264 | 6/1990 | Huang . | |
| 5,191,738 | 3/1993 | Nakazato et al. . | |
| 5,423,716 | 6/1995 | Strasbaugh . | |
| 5,441,444 | 8/1995 | Nakajima . | |
| 5,541,442 | 7/1996 | Keil et al. . | |
| 5,584,746 | 12/1996 | Tanaka et al. . | |
| 5,597,346 | 1/1997 | Hempel, Jr. . | |
| 5,605,487 | 2/1997 | Hileman et al. . | |
| 5,605,488 | 2/1997 | Ohashi et al. | 451/288 |
| 5,762,539 | 6/1998 | Nakashiba et al. | 451/41 |
| 5,762,546 | 6/1998 | James et al. | 451/505 |
| 5,800,248 | 9/1998 | Pant et al. | 451/41 |

*Primary Examiner*—David A. Scherbel
*Assistant Examiner*—George Nguyen
*Attorney, Agent, or Firm*—Beyer & Weaver, LLP

[57] ABSTRACT

Methods and apparatus for planarizing the surface of a semiconductor wafer by applying non-uniform pressure distributions to a polishing pad are disclosed. According to one aspect of the present invention, a chemical mechanical polishing apparatus for polishing a surface of a semiconductor wafer includes a polishing pad with a first surface and a second surface. The first surface of the polishing pad is arranged to contact the surface of the semiconductor wafer in order to polish the surface of the semiconductor wafer. The apparatus also includes a mechanism which is used to apply a non-uniform pressure distribution over the second surface of the polishing pad, wherein applying the non-uniform pressure distribution to the polishing pad facilitates evenly polishing the surface of the semiconductor wafer. In one embodiment, the mechanism for applying the non-uniform pressure distribution to the polishing pad is an air bladder arrangement.

17 Claims, 5 Drawing Sheets

METHOD AND APPARATUS FOR USING PRESSURE DIFFERENTIALS THROUGH A POLISHING PAD TO IMPROVE PERFORMANCE IN CHEMICAL MECHANICAL POLISHING

BACKGROUND OF THE INVENTION

1. Field of Invention

The present invention relates generally to methods and apparatus for polishing the surface of a semiconductor wafer using a chemical mechanical polishing process. More particularly, the present invention relates to methods and apparatus for applying pressure differentials through a polishing pad to improve the performance of chemical mechanical polishing processes.

2. Description of Relevant Art

Chemical mechanical polishing, which is often referred to as "CMP," typically involves mounting a wafer, faced down, on a holder and rotating the wafer face against a polishing pad mounted on a platen. The platen is generally either rotating or in an orbital state. A slurry containing a chemical that chemically interacts with the facing wafer surface layer and an abrasive that physically removes portions of the surface layer is flowed between the wafer and the polishing pad, or on the pad in the vicinity of the wafer.

In semiconductor wafer fabrication, CMP is often utilized in an effort to planarize various wafer layers which may include layers such as dielectric layers and metallization layers. The planarity of the wafer layers is crucial for many reasons. For example, during wafer fabrication, planar layers reduce the likelihood of the accidental coupling of active conductive traces between different metallization layers, e.g., layers of active conductive traces, on integrated circuits housed on the wafer. Planar layers further provide a surface with a constant height for any subsequent lithography processes.

Polishing pressure, or the pressure applied to a wafer by a polishing pad, is generally maintained at a constant, e.g., uniform, level across the wafer. A uniform polishing pressure is maintained in an effort to ensure that the same amount of material, or film, is removed from all sections on the surface of a wafer. The amount of material removed from the surface of a wafer is governed by Preston's Equation, which states that the amount of material removed from the surface of a wafer is proportional to the product of polishing pressure and the relative velocity of the wafer. The relative velocity of the wafer is generally a function of the rotation of the wafer. Using Preston's Equation, if the relative velocity of the wafer is maintained at a constant level, and the polishing pressure is at a uniform level across the wafer, then the amount of material removed from the wafer is constant.

In general, many methods may be used to maintain a uniform polishing pressure. One method which is often used to maintain a uniform polishing pressure involves the use of an air bladder. FIG. 1 shows a cross-sectional representation of a chemical mechanical polishing pad sub-assembly 100 which may be used with a CMP apparatus such as an Avantgaard 676, available commercially from Integrated Processing Equipment Corporation (IPEC) of Phoenix, Ariz. A polishing pad 104 adheres to a flexible platen, or pad backer 108. An air bladder 112, which is arranged to inflate and deflate, is disposed between a plumbing reservoir 118 and pad backer 108.

Inflating air bladder 112, which is generally fabricated from an elastic material, effectively serves to apply a uniform pressure to polishing pad 104 and, hence, a wafer which is being polished using polishing pad sub-assembly 100. In general, air bladder 112 is arranged to essentially press against approximately the entire bottom surface of air bladder 112.

In an apparatus such as the Avantgaard 676, a slurry mesh 120 may be arranged between pad backer 108 and air bladder 112 as part of a system which is used to deliver slurry to the surface of polishing pad 104. Air bladder 112 then serves the additional purpose of pressurizing slurry mesh 120 to deliver slurry to the surface of polishing pad 104.

Although applying a uniform pressure to a polishing pad is generally effective to create a planar wafer surface, once the polishing pad has been repeatedly used, e.g., is near the end of its pad life, the effectiveness of the polishing pad decreases. That is, maintaining a uniform polishing pressure is not as effective in planarizing the wafer surface. Since replacing polishing pads is time-consuming and expensive, a polishing pad is typically repeatedly used until nonuniformity on the surfaces of wafers polished using the polishing pad is at a level which is considered to be unacceptable. Generally, after a polishing pad has been repeatedly used to polish wafers over a period of time, the polishing pad has a tendency to become "glazed." As is well known in the art, pad glazing occurs when the particles eroded from wafer surfaces, in addition to particles from abrasives in the slurry, glaze or otherwise accumulate over the polishing pad.

Pad glazing is generally most evident during CMP performed on an oxide layer such as a silicon dioxide layer. Herein and after, CMP performed on an oxide layer will be referred to as "oxide CMP." During oxide CMP, eroded silicon dioxide particulate residue, along with abrasives in the slurry, have the tendency to glaze the polishing pad. When pad glazing occurs, the polishing rate of the wafer surface is reduced, and a non-uniformly polished wafer surface is produced due to uneven removal of the glaze. By way of example, the peripheral region of the wafer surface may not be polished to the same extent as the center region of the wafer surface, due to conditions such as center-fast polishing and center-slow polishing. Center-fast polishing occurs when the material removal rate near the center, i.e., axial center, of a wafer surface is higher than the material removal rate away from the center of the wafer, whereas center-slow polishing occurs when the material removal rate near the center of a wafer surface is slower than the material removal rate away from the center of the wafer surface, as is well-known to those skilled in the art.

As such, what is desired is a method and apparatus for reducing wafer surface non-uniformity that occurs during CMP after a polishing pad has been used repeatedly. In other words, what is desired is a method and apparatus which enables the effectiveness of a polishing pad to be prolonged.

SUMMARY OF THE INVENTION

In accordance with the present invention, non-uniform pressure distributions are provided on the bottom surface of a polishing pad to enable the polishing pressure to be varied across the polishing pad and, hence, a semiconductor wafer which is being polished by the polishing pad. Varying the polishing pressure across the polishing pad enables problems which may arise when a polishing pad has been used repeatedly, e.g., center slow polishing, to be alleviated. By way of example, to compensate for center slow polishing, the pressure applied around the axial center of the polishing pad may be higher than pressures applied away from the center of the pad.

According to one aspect of the present invention, a chemical mechanical polishing apparatus for polishing a surface of a semiconductor wafer includes a polishing pad with a first surface and a second surface. The first surface of the polishing pad is arranged to contact the surface of the semiconductor wafer in order to polish the surface of the semiconductor wafer. The apparatus also includes a mechanism which is used to apply a non-uniform pressure distribution over the second surface of the polishing pad, wherein applying the non-uniform pressure distribution to the polishing pad facilitates evenly polishing the surface of the semiconductor wafer. In one embodiment, the mechanism for applying a non-uniform pressure distribution to the polishing pad is an air bladder arrangement. In such an embodiment, the air bladder arrangement may include a chambered air bladder with a first chamber that is pressurized at a first pressure and a second chamber that is pressurized at a second pressure. Alternatively, the air bladder arrangement may include a first air bladder inflated as a first pressure and a second air bladder inflated at a second pressure.

According to another aspect of the present invention, a chemical mechanical polishing apparatus for polishing a surface of a semiconductor wafer includes a polishing pad, with a first surface which is arranged to polish the wafer, and a mechanism for applying pressure to the polishing pad. The mechanism is arranged to apply pressure only to selected sections of a second surface of the polishing pad. Applying pressure to the selected sections of the second surface of the polishing pad creates a non-uniform pressure distribution on the second surface of the polishing pad which facilitates polishing the surface of the semiconductor wafer such that the surface of the semiconductor is evenly polished. In one embodiment, the apparatus includes a pad backer arranged below the polishing pad such that at least a portion of the pad backer is in contact with the second surface of the polishing pad to secure the polishing pad.

In another embodiment, the mechanism for applying the non-uniform pressure distribution to the polishing pad is an air bladder mechanism that is arranged to apply air pressure to the selected sections of the second surface of the polishing pad. In such an embodiment, the air bladder mechanism may include a plurality of air bags, the plurality of air bags being at substantially the same pressure.

In accordance with still another aspect of the present invention, a method for planarizing a semiconductor wafer surface includes applying a non-uniform pressure distribution to a chemical mechanical polishing pad, wherein the non-uniform pressure distribution is applied from beneath the chemical mechanical polishing pad. The method also involves polishing the surface of the semiconductor wafer using the chemical mechanical polishing pad. In one embodiment, applying the non-uniform pressure distribution to the chemical mechanical polishing pad includes pressurizing an air bladder assembly that is located beneath the chemical mechanical polishing pad. In another embodiment, applying the non-uniform pressure distribution involves applying a combination of a positive pressure and a negative pressure.

These and other features and advantages of the present invention will be presented in more detail in the following detailed description of the invention and in the associated figures.

BRIEF DESCRIPTION OF THE DRAWINGS

The invention may best be understood by reference to the following description taken in conjunction with the accompanying drawings in which.

DETAILED DESCRIPTION OF THE EMBODIMENTS

The planarity, or uniformity, of the surface of a semiconductor wafer layer is important to reduce the likelihood of metallization lines in different metallization layers being accidentally coupled. One process which is used to form planar surfaces on a wafer is chemical mechanical polishing (CMP). While CMP is generally effective in forming planar surfaces on wafers, when polishing pads used in CMP become glazed, the polishing rate of wafer surfaces may be reduced. As a result, non-uniformly polished wafer surfaces may be produced due to uneven removal of the glaze.

By applying pressure differentials to a polishing pad, the polishing pad may consistently and uniformly polish wafer surfaces, even after the polishing pad has been used extensively. Specifically, applying pressure differentials, or non-uniform pressure distributions, from beneath the polishing pad allows polishing pressures exerted between the polishing pad and the surface of a wafer to be varied. As such, by varying pressures applied beneath the polishing pad as necessary, polishing pressures across a wafer may then be effectively varied to enable a CMP process to produce a planar surface on the wafer. That is, the film removal rate may be varied by varying the polishing pressure. For example, less material is removed from the surface of a wafer as the polishing rate of the wafer decreases. Therefore, by increasing the polishing pressure, the amount of material removed from the wafer may be increased. In general, polishing pressures may be varied between both positive pressures and negative pressures, e.g., vacuums. By way of example, both a positive pressure and a negative pressure may be simultaneously applied to different sections a polishing pad to achieve differential polishing pressures across a wafer.

Many CMP systems use polishing pad sub-assemblies which include air bladders. One CMP apparatus which uses an air bladder is an Avantgaard 676, which is available commercially from Integrated Processing Equipment Corporation (IPEC) of Phoenix, Ariz. A pressure differential may be created through a polishing pad by modifying the structure of the air bladder. By way of example, the structure of the air bladder may be modified to include chambers which may be inflated to different pressures to thereby create a pressure differential.

Figure 1:
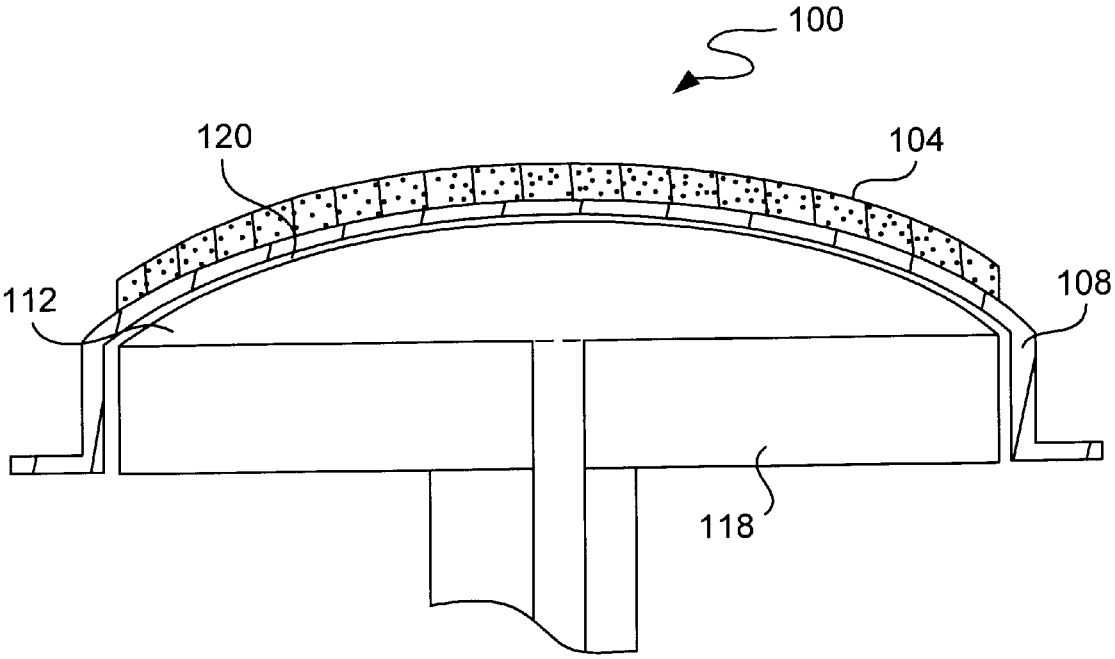
FIG. 1 (PRIOR ART)
FIG. 1 is a side-view representation of a chemical mechanical polishing pad sub-assembly in accordance with prior art.
Figure 2A:
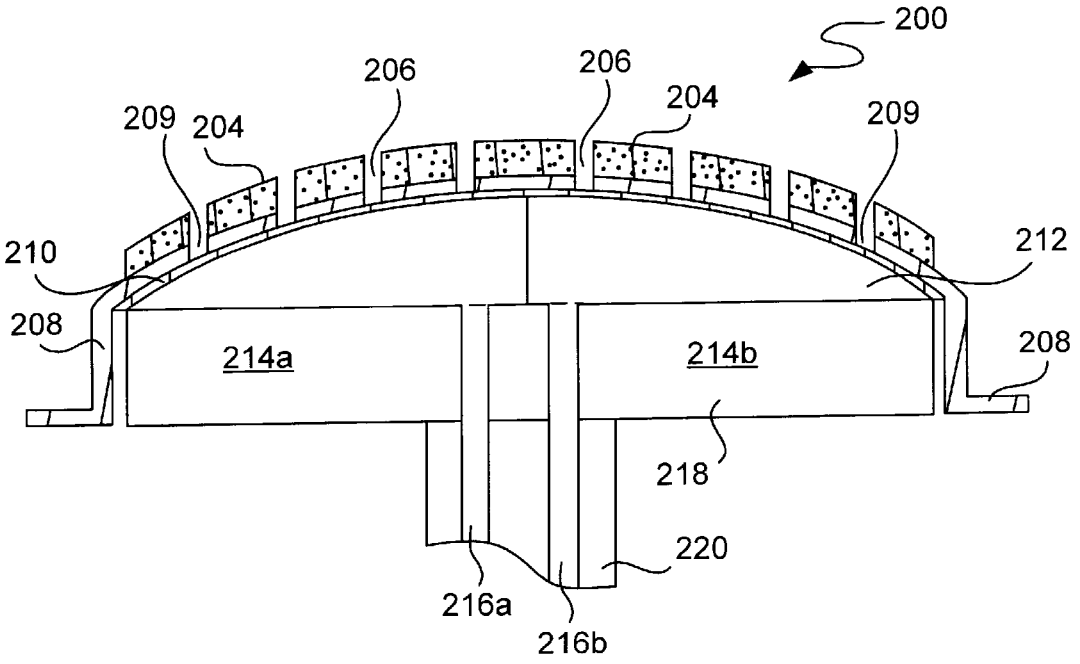
FIG. 2*a* is a side-view representation of a chemical mechanical polishing pad sub-assembly with a chambered air bladder in accordance with a first embodiment of the present invention.

With reference to FIG. 2*a*, a CMP sub-assembly with a chambered air bladder will be described in accordance with an embodiment of the present invention. A CMP sub-assembly 200 includes a polishing pad 204 which has a plurality of slurry injection holes 206, and adheres to a flexible pad backer 208. Pad backer 208 includes a plurality of pad backer holes 209 that are aligned with slurry injection holes 206. A slurry mesh 210, which is typically in the form of a screen-like structure, is positioned below pad backer 208. It should be appreciated that for ease of illustration, some features of CMP sub-assembly 200 that relate to slurry delivery are not shown. For example, an inlet for delivering slurry to slurry mesh 210 is not shown. It should be appreciated, however, that slurry delivery features may generally be included as a part of CMP sub-assembly 200.

A chambered air bladder 212, which is arranged such that a first chamber 214*a* and a second chamber 214*b* of chambered air bladder 212 may be inflated and deflated substantially independently, is disposed between a plumbing reservoir 218 and slurry mesh 210. A co-axial shaft 220, through which inlets 216 to chambered air bladder 212 are provided, is coupled to plumbing reservoir 218.

The number of chambers in chambered air bladder 212, as well as the shapes of the chambers, may be widely varied. One configuration of chambered air bladder 212 will be described below with reference to FIG. 2*b*. Chambers 214 of chambered air bladder 212 may be pressurized such that at least some of chambers 214 are at different pressures, thereby creating a differential pressure against polishing pad 204.

Separate inlets 216 to chambers 214 enable chambers 214 to be inflated and deflated, and, as a result, pressurized and depressurized, substantially independently. As shown, inlet 216*a* is associated with chamber 214*a*, while inlet 216*b* is associated with chamber 216*b*. Therefore, the pressures, e.g., air pressures, in chambers 214*a* and 214*b* may differ from one another, as the pressure in chamber 214*a* is substantially unaffected by the pressure in chamber 214*b*, and vice versa.

Figure 2B:
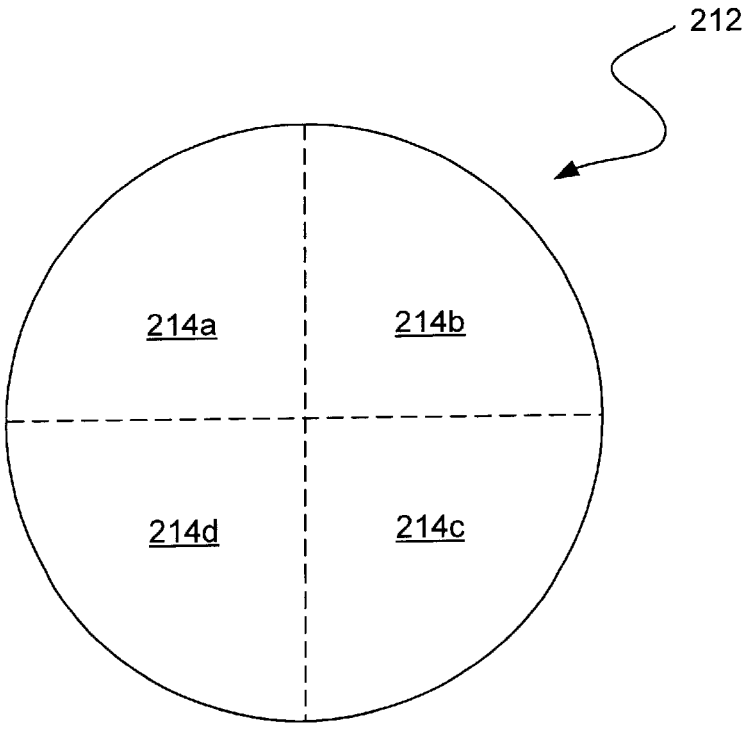
FIG. 2*b* is a top-view representation of the chambered air bladder of FIG. 2*a* in accordance with the first embodiment of the present invention.

FIG. 2*b* is a diagrammatic top-view representation of chambered air bladder 212 of FIG. 2*a* in accordance with an embodiment of the present invention. As previously mentioned, chambered air bladder 212 may generally include any number of different chambers. In the described embodiment, chambered air bladder 212 includes four chambers 214. It should be appreciated that although a chamber 214, e.g., chamber 214*a*, may generally have a dedicated inlet which is arranged to pressurize or depressurize chamber 214*a*, in one embodiment, at least some of chambers 214 may share a single inlet.

As shown, all chambers 214 have substantially the same size and shape. However, in general, each chamber 214 may have a size and shape which differs from that of other chambers 214. By way of example, chambered air bladder 212 may include chambers arranged as a series of toruses. Further, although chambered air bladder 212 has been shown as covering substantially the entire top surface of plumbing reservoir 218, chambered air bladder 212 may, alternatively, only cover a portion of the surface. In the described embodiment, since chambered air bladder 212 essentially covers the top surface of plumbing reservoir 218, chambered air bladder 212 also applies pressure directly to substantially the entire bottom surface of polishing pad 204, as shown in FIG. 2*a*.

Figure 3A:
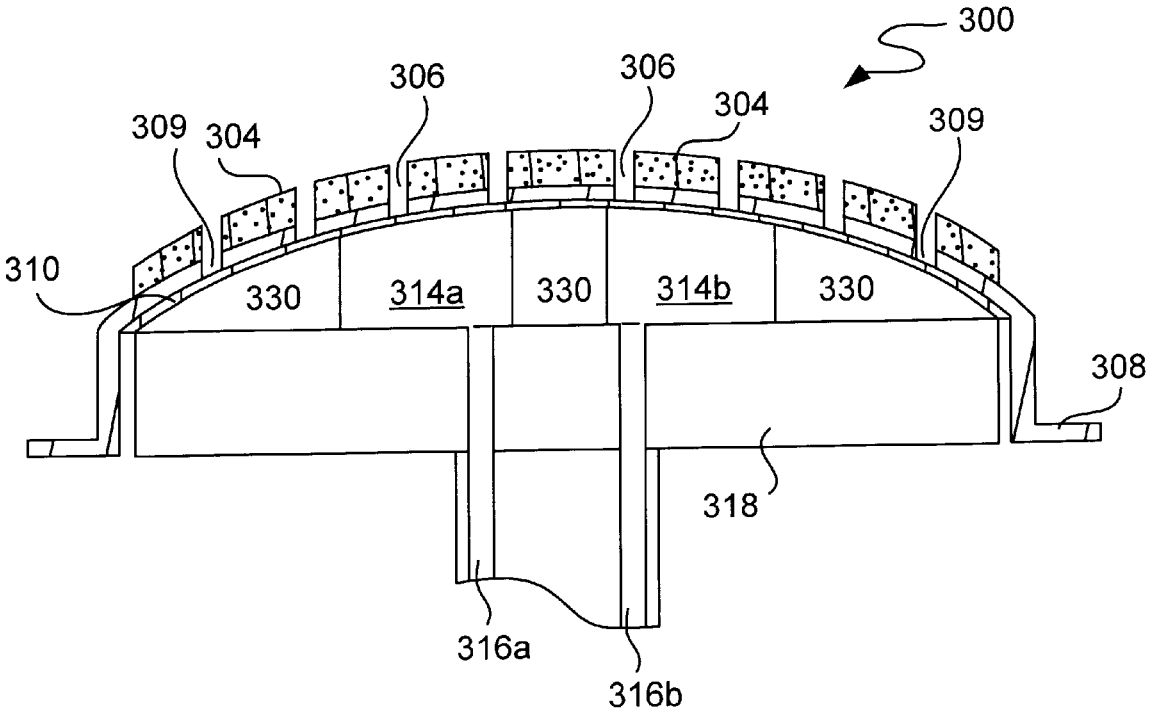
FIG. 3*a* is a side-view representation of a chemical mechanical polishing sub-assembly with a plurality of air bladders in accordance with a second embodiment of the present invention.

In lieu of a chambered air bladder, a plurality of air bladders may instead be used to apply a pressure differential to the back of a polishing pad. In other words, multiple air bladders may be used to serve the function of a single, multi-chambered air bladder. FIG. 3*a* is a diagrammatic cross-sectional representation of a CMP sub-assembly with multiple air bladders in accordance with an embodiment of the present invention. A CMP sub-assembly 300 includes a polishing pad 304 which, in the described embodiment, has a plurality of slurry injection holes 306, and adheres to a flexible pad backer 308. Pad backer 308, as shown, includes a plurality of pad backer holes 309 that are aligned with slurry injection holes 306. A slurry mesh 310 is positioned below pad backer 308. As was the case for CMP sub-assembly 200 of FIG. 2*a*, some features of CMP sub-assembly 300, particularly those that relate to slurry delivery, are not shown for ease of illustration.

CMP sub-assembly 300 includes a plurality of air bladders 314 which are arranged to pressurize slurry mesh 310 and to provide pressure to polishing pad 304. Air bladders 314 may take on many different shapes, as for example a roughly cylindrical shape, and may be of many different sizes. Air bladders 314 may further be arranged in a variety of different configurations. As shown, air bladders 314*a*, 314*b* are set apart from one another, as will be described below with reference to FIG. 3*b*. In the described embodiment, air bladders 314 have separate inlets 316 which are arranged to pressurize air bladders 314. That is, air bladder 314*a* is pressurized by inlet 316*a*, while air bladder 314*b* is pressurized by inlet 316*b*.

A differential pressure may be applied to polishing pad 304 by inflating air bladder 314*a* to a different pressure than air bladder 314*b*. Alternatively, a differential pressure may also be applied by applying substantially the same pressure to both air bladders 314*a* and 314*b*, since air bladders 314*a*, 314*b* are not arranged to directly apply pressure to approximately all of the bottom surface of polishing pad 304. In the described embodiment, there are empty spaces 330 around air bladders 314. Spaces 330 which are not arranged to apply pressure to polishing pad 304. In other words, air bladders 314 are arranged to "push" only on portions of polishing pad 304. Accordingly, inflating air bladders 314 to substantially the same pressure may still enable a differential pressure to be applied to polishing pad 304, since portions of polishing pad 304 over spaces 330 are not subjected to direct pushing by air bladders 314.

Figure 3B:
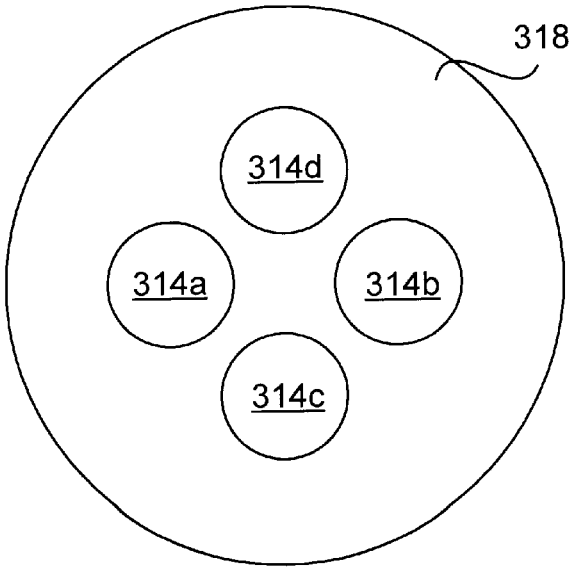
FIG. 3*b* is a top-view representation of the plurality of air bladders of FIG. 3*a* in accordance with the second embodiment of the present invention.

FIG. 3*b* is a diagrammatic top-view representation of multiple air bladders 314 situated over plumbing reservoir 318 of FIG. 3*a* in accordance with an embodiment of the present invention. Air bladders 314 are spaced apart from one another and are not arranged to cover essentially all of the top surface of plumbing reservoir 318. It should be appreciated that although the surface areas of plumbing reservoir 318 and polishing pad 304 of FIG. 3*a* are not necessarily comparable in size, in the described embodiment, the surface areas are approximately the same size. As such, since air bladders 314 do not cover the entire surface of plumbing reservoir 318, air bladders 314 are also not arranged to "directly" apply pressure to the entire bottom surface of polishing pad 304. That is, portions of polishing pad 304 which are positioned over spaces 330 are not subjected to the direct application of pressure by air bladders 314. Therefore, as mentioned above, a pressure differential may be applied to polishing pad 304 both by inflating air bladders 314 to different pressures and by inflating air bladders 314 to substantially the same pressure.

In general, air bladders may take on a variety of different orientations which allow the air bladders to apply a pressure differential to a polishing pad. By way of example, a single air bladder may be arranged to apply a selected pressure to only selected areas of the bottom surface of a polishing pad. The selected areas along the bottom surface of the polishing pad on which pressure is directly applied by the air bladder, in conjunction with areas of the bottom of the polishing pad on which pressure is not directly applied by the air bladder, serve to apply a pressure differential to the bottom surface of the air bladder.

Figure 4A:
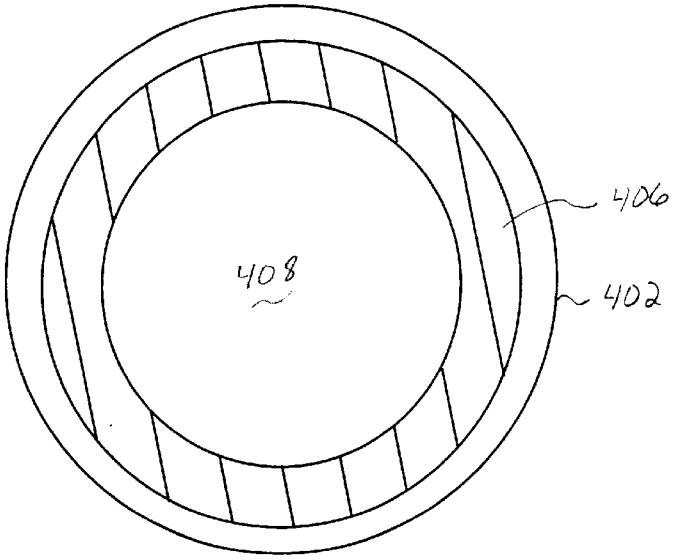
FIG. 4*a* is a top-view representation of an air bladder arranged as a torus in accordance with a third embodiment of the present invention.

FIG. 4*a* is a diagrammatic representation of an air bladder which is shaped as a torus in accordance with an embodiment of the present invention. Air bladder 406, as shown with respect to a plumbing reservoir 402 that is used with a polishing apparatus, is shaped as a torus and is centered approximately around the center of plumbing reservoir 402. It should be appreciated that, in the described embodiment, a polishing pad (not shown) is axially centered with respect to plumbing reservoir. Therefore, centering air bladder 406 with respect to plumbing reservoir 402 entails centering air bladder 406 with respect to the polishing pad. Plumbing reservoir 402 is shown in lieu of a polishing pad for ease of illustration.

In one embodiment, although air bladder 406 may include a plurality of chambers, air bladder 406 is pressurized such that all of air bladder 406 is under approximately the same pressure. As such, the pressure exerted by air bladder 406 through a polishing pad (not shown), which is centered over plumbing reservoir 402, is centered with respect to the polishing pad, e.g., pressure applied by air bladder 406 is applied at a fixed radius around the polishing pad. Portions of the polishing pad which are not in contact with air bladder 406 are typically under a different pressure than the portions of the polishing pad which are in contact with air bladder 406. Therefore, a pressure differential is created on the polishing pad.

For embodiments in which the pressure of air bladder 406 is higher than the ambient pressure, e.g., the pressure associated with space 408 over plumbing reservoir 402, the pressure differential created on a polishing pad may be sufficient to compensate for polishing non-uniformities which are associated with center-fast polishing. In other words, by not applying pressure in space 408, the section of a polishing pad which is directly over space 408 will have essentially no pressure applied thereon, whereas the section of polishing pad which is directly over air bladder 406 will have a positive pressure applied thereon. As such, the polishing pressure associated with the center of the polishing pad is reduced with respect to other portions of the polishing pad, thereby reducing the effects of center-fast polishing.

As described above with respect to FIGS. 3*a* and 3*b*, a plurality of air bladders may also be implemented for use in CMP processes. While the arrangement of the air bladders beneath a polishing pad may vary, certain arrangements of air bladders are preferable to compensate for problems such as center-fast polishing and center-slow polishing. In order to compensate for center-fast polishing and center-slow polishing, differential pressure may be applied to a polishing pad such that the area around the center, i.e., axial-center, of the polishing pad is at a different pressure than areas away from the center of the polishing pad. For example, a lower pressure may be applied near the center of the polishing pad than near the periphery of the polishing pad to alleviate the effects of center-fast polishing. Conversely, a higher pressure may be applied near the center of the polishing pad than near the periphery of the polishing pad to compensate for the effects of center-slow polishing.

Figure 4B:
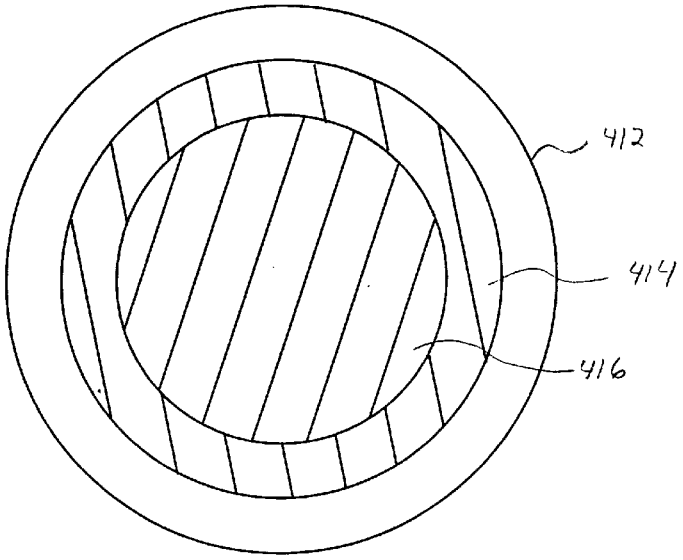
FIG. 4*b* is a top-view representation of nested air bladders in accordance with a fourth embodiment of the present invention.

One arrangement of a plurality of air bladders which may be suitable for use in compensating for center-fast polishing and center-slow polishing involves implementing substantially concentric air bladders. FIG. 4*b* is a diagrammatic representation of two approximately concentric air bladders shown with respect to a plumbing reservoir in accordance with an embodiment of the present invention. Air bladders 414, 416 are shown with respect to a plumbing reservoir 412 that is arranged to be aligned below a polishing pad (not shown) such that plumbing reservoir 412 is axially centered with respect to the polishing pad.

As shown, air bladder 414 has a ring-like cross-section and air bladder 416 has a substantially circular shape. As such, in one embodiment, air bladder 414 is shaped like a torus, while air bladder 416 is approximately cylindrical in shape. Air bladder 416 is generally centered with respect to plumbing reservoir 412, while air bladder 414 is centered around air bladder 416. When air bladder 416 is pressurized to a higher pressure than air bladder 414, the portion of a polishing pad, e.g., the center portion, which is contacted by air bladder 416 will have a higher pressure than the portion of the polishing pad which comes into contact with air bladder 414. Therefore, a higher pressure in air bladder 416, in cooperation with a lower pressure in air bladder 414, serves to alleviate center-slow polishing problems, as will be appreciated by those skilled in the art.

Alternatively, air bladder 416 may be pressurized to a lower pressure than air bladder 414. Accordingly, a central portion of a polishing pad which is in contact with air bladder 416 will generally experience a lower pressure than more peripheral portions of the polishing pad which are in contact with air bladder 414. As a result, pressurizing air bladder 416 to a lower pressure than air bladder 414 may be effective to reduce the effects of center-fast polishing.

Figure 5:
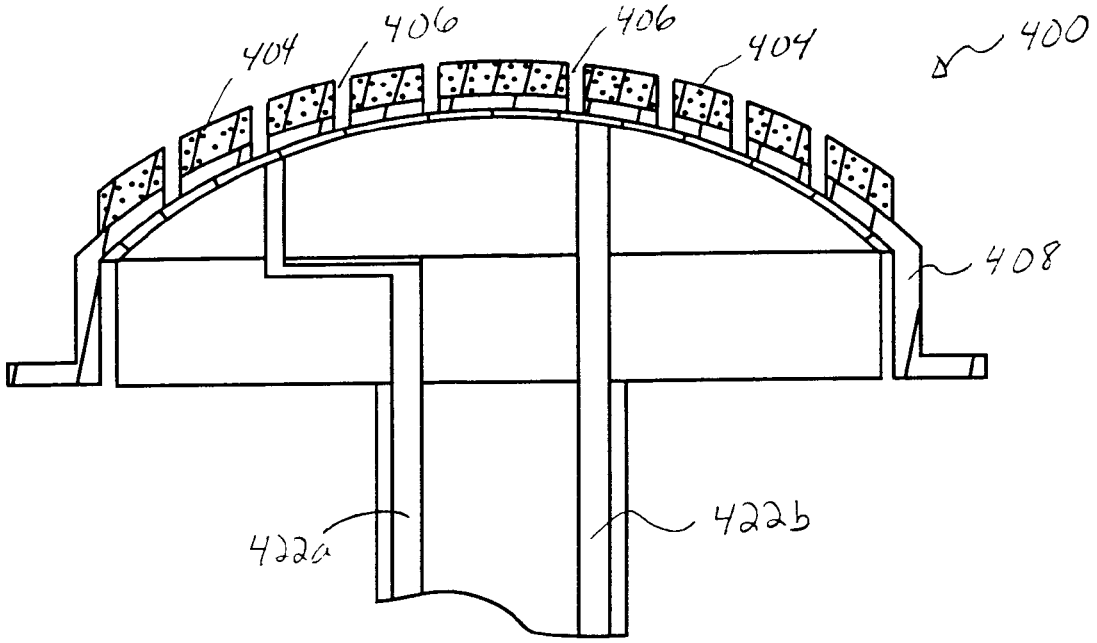
FIG. 5 is a side-view representation of a chemical mechanical polishing sub-assembly with a plurality of air inlets in accordance with a fifth embodiment of the present invention.

Instead of air bladder assemblies, another mechanism which is suitable for use in creating a pressure differential through a polishing pad uses air inlets which release streams, or jets, of air to generate streams of air that push against portions of the bottom surface of the polishing pad. Referring next to FIG. 5, a CMP sub-assembly with air inlets which are arranged to push against a polishing pad will be described in accordance with an embodiment of the present invention. A CMP sub-assembly 400 includes a polishing pad 404 which, in the described embodiment, has a plurality of slurry injection holes 406, and adheres to a flexible pad backer 408.

Air inlets 422 are arranged to provide pressure against pad backer 408 and, hence, polishing pad 404. In general, air inlets 422 may be arranged to provide both positive pressures and negative pressures, e.g., vacuums, and are directed at different sections of polishing pad 404. Accordingly, if the pressure of the stream of air provided by air inlet 422*a* is different from the pressure of the stream of air provided by air inlet 422*b*, a pressure differential is effectively produced through polishing pad 404. Since there are portions of polishing pad 404 at which air streams from air inlets 422 are not directed, even if air inlets 422 are arranged to provide air streams at substantially the same pressure, a pressure differential is effectively created through polishing pad 404.

The number of air inlets 422 may vary depending upon the desired magnitude of a pressure differential which is to be provided through polishing pad 404. By way of example, the number of air inlets 422 may range from a single air inlet to approximately seventy air inlets. Further, in some embodiments, air inlets 422 may include diffuser mechanisms which are arranged to distribute air streams across the bottom surface of polishing pad 404.

Although only a few embodiments of the present invention have been described, it should be understood that the present invention may be embodied in many other specific forms without departing from the spirit or scope of the invention. By way of example, although air bladders have been described as each having a dedicated air inlet, at least some air bladders may share a common air inlet. Air bladders which are spaced apart from one another beneath a polishing pad may all be inflated to substantially the same pressure, while still enabling an overall pressure differential to be applied to the polishing pad. Likewise, at least some chambers in a chambered air bladder may also share a single air inlet, particularly when the chambered air bladder is not arranged to directly apply pressure to substantially the entire bottom surface of the polishing pad.

In addition, while some air bladders have been shown as being toroidal in shape while other air bladders have been shown as being approximately cylindrical in shape, it should be appreciated that air bladders may take on a variety of other shapes. The different shapes of air bladders may, for example, facilitate the passage of slurry inlet lines through or around the air bladders. In some embodiments, air bladders may be "irregularly" shaped, as for example shaped with both rounded edges and squared corners, without departing from the spirit or the scope of the present invention.

A plurality of air bladders have been described as being arranged such that the air bladders are concentric with respect to one another. In general, a chambered air bladder may be configured to include concentric chambers. In other words, it should be appreciated that the functionality of a plurality of concentrically arranged air bladders may be served by a chambered air bladder which includes concentric chambers.

Although the application of differential pressures through a polishing pad has been described as being used with a CMP system which includes a pad backer and a slurry mesh, the application of differential pressures may be implemented for use with many other CMP systems. In other words, while the application of differential pressures through a polishing pad has been described as being used with a CMP system which delivers slurry from beneath the polishing pad, differential pressures may be applied from beneath the polishing pad in other systems as well. By way of example, pressure differentials may be applied from beneath a polishing pad for CMP systems which dispense slurry over the top of the polishing pad without departing from the spirit or the scope of the present invention. Therefore, the present examples are to be considered as illustrative and not restrictive, and the invention is not to be limited to the details given herein, but may be modified within the scope of the appended claims.

What is claimed is:

1. A chemical mechanical polishing apparatus for polishing a surface of a semiconductor wafer, the apparatus comprising:

a polishing pad with a first surface and a second surface, the first surface of the polishing pad being arranged to contact the surface of the semiconductor wafer to polish the surface of the semiconductor wafer, whereby said polishing occurs through a rotational or orbital motion of said polishing pad about an axis that is normal to the face of said polishing pad; and a bladder arrangement for applying a non-uniform pressure distribution over the second surface of the polishing pad, wherein applying the non-uniform pressure distribution over the second surface of the polishing pad facilitates polishing of the surface of the semiconductor wafer such that the surface of the semiconductor is evenly polished.

2. An apparatus as recited in claim 1 further including a pad backer arranged below the polishing pad, wherein at least a portion of the pad backer is in contact with the second surface of the polishing pad to secure the polishing pad.

3. An apparatus as recited in claim 1 wherein the bladder arrangement for applying the non-uniform pressure distribution over the second surface of the polishing pad is an air bladder arrangement.

4. An apparatus as recited in claim 3 wherein the air bladder arrangement for applying the non-uniform pressure distribution over the second surface of the polishing pad includes a plurality of air lines.

5. An apparatus as recited in claim 3 wherein the air bladder arrangement includes a chambered air bladder, the chambered air bladder being arranged such that a first chamber of the chambered air bladder is at a first pressure and a second chamber of the chambered air bladder is at a second pressure.

6. An apparatus as recited in claim 3 wherein the air bladder arrangement includes a chambered air bladder, the chambered air bladder including chambers which are arranged to be pressurized separately.

7. An apparatus as recited in claim 3 wherein the air bladder arrangement includes a first air bladder and a second air bladder, the first air bladder being at a first pressure and the second air bladder being at a second pressure.

8. A chemical mechanical polishing apparatus for polishing a surface of a semiconductor wafer, the apparatus comprising:

a polishing pad with a first surface and a second surface, the first surface of the polishing pad being arranged to polish the surface of the semiconductor wafer, whereby said polishing occurs through a rotational or orbital motion of said polishing pad about an axis that is normal to the face of said polishing pad; and a bladder mechanism for applying pressure to the polishing pad, the mechanism being arranged to apply pressure only to selected sections of the second surface of the polishing pad, wherein applying pressure to the selected sections of the second surface of the polishing pad creates a non-uniform pressure distribution on the second surface of the polishing pad to facilitate polishing the surface of the semiconductor wafer such that the surface of the semiconductor is evenly polished.

9. An apparatus as recited in claim 8 further including a pad backer arranged below the polishing pad, wherein at least a portion of the pad backer is in contact with the second surface of the polishing pad to secure the polishing pad.

10. An apparatus as recited in claim 8 wherein the bladder mechanism for applying pressure to the polishing pad is an air bladder mechanism, the air bladder mechanism being arranged to apply air pressure to the selected sections of the second surface of the polishing pad.

11. An apparatus as recited in claim 10 wherein the air bladder mechanism includes a chambered air bladder, the chambered air bladder being arranged such that a first chamber of the chambered air bladder is at a first pressure and a second chamber of the chambered air bladder is at a second pressure.

12. An apparatus as recited in claim 10 wherein the air bladder mechanism includes a first air bladder and a second air bladder, the first air bladder being at a first pressure and the second air bladder being at a second pressure.

13. An apparatus as recited in claim 10 wherein the air bladder mechanism includes a plurality of air bags, the plurality of air bags being at substantially the same pressure.

14. A method for planarizing a semiconductor wafer surface comprising:

applying a non-uniform pressure distribution to a chemical mechanical polishing pad, wherein the non-uniform pressure distribution is applied from a bladder assembly located beneath the chemical mechanical polishing pad; and polishing the semiconductor wafer surface using a rotational or orbital motion of the chemical mechanical polishing pad about an axis that is normal to the face of the chemical mechanical polishing pad, the semiconductor wafer being held above the polishing pad.

15. A method as recited in claim 14 further including adjusting the non-uniform pressure distribution as necessary to achieve a desired level of planarity on the semiconductor wafer surface.

16. A method as recited in claim 14 wherein applying the non-uniform pressure distribution to the chemical mechanical polishing pad includes pressurizing an air bladder assembly, the air bladder assembly being located beneath the chemical mechanical polishing pad.

17. A method as recited in claim 14 wherein applying the non-uniform pressure distribution involves applying a combination of a positive pressure and a negative pressure.

* * * * *